United States Patent [19]

Eaton

[11] 4,052,587

[45] Oct. 4, 1977

[54] HTW HEATING SYSTEM HAVING AN ELECTRODE STEAM BOILER AS THE DIRECT SOURCE OF HTW

[76] Inventor: Milton Eaton, 363 Ninth St., Shawinigan, Quebec, Canada

[21] Appl. No.: 725,033

[22] Filed: Sept. 20, 1976

Related U.S. Application Data

[63] Continuation-in-part of Ser. No. 559,981, March 19, 1975, abandoned, which is a continuation-in-part of Ser. No. 505,995, Sept. 16, 1974, abandoned.

[51] Int. Cl.[2] ..... H05B 3/60; F22B 1/16; F24D 3/02

[52] U.S. Cl. ..... 219/295; 219/273; 219/286; 219/326; 219/341; 237/59; 338/86

[58] Field of Search ..... 219/284-295, 219/271-276, 326, 341, 365; 338/80-86; 237/59, 60, 62, 63, 66

[56] References Cited

U.S. PATENT DOCUMENTS

| | | | |
|---|---|---|---|
| 2,783,356 | 2/1957 | Eaton | 219/290 |
| 2,986,623 | 5/1961 | Eaton | 219/290 |
| 3,138,696 | 6/1964 | Eaton | 219/292 X |
| 3,824,372 | 7/1974 | Eaton | 219/289 X |
| 3,862,395 | 1/1975 | Eaton | 219/284 |

*Primary Examiner*—A. Bartis

[57] ABSTRACT

A high temperature water (HTW) space heating system in which the direct source of HTW is an automatic electrode steam boiler having electrodes, adapted to be connected in an electrical distribution system. The electrodes are positioned in corresponding steam generating compartments surrounded by a control compartment. A corresponding water spout directs water toward the tip of each electrode. A regulating valve allows only a limited steam output, which is used for control purposes. Water is taken from the boiler and mixed with water from an outside source. A boiler water circulating group feeds the mixed water to the spouts with sufficient velocity for it to flow up the surface of the electrodes to the water level in the steam generating compartments. The system has a heated space circuit including a pump for circulating HTW. An HTW supply circuit connects the boiler with the heated spaces circuit and provides unrestricted flow of HTW from the boiler to the heated spaces circuit so that the boiler serves as a pressurized expansion tank for the heating system. A diversion circuit is connected between the heated spaces circuit and the inlet of the boiler water circulating pump. A control valve arrangement diverts a controlled amount of HTW from the heated spaces circuit to the pump inlet through the diversion circuit. Such diverted HTW constitutes water from an outside source and is replaced in the heated spaces circuit by HTW from the boiler through HTW supply circuit.

11 Claims, 3 Drawing Figures

HTW HEATING SYSTEM HAVING AN ELECTRODE STEAM BOILER AS THE DIRECT SOURCE OF HTW

CROSS REFERENCE TO RELATED APPLICATIONS

The present application is a continuation-in-part of prior U.S. application Ser. No. 559,981, which was filed on Mar. 19, 1975, and now abandoned. The prior U.S. application in turn is a continuation-in-part of still earlier U.S. application Ser. No. 505,995, filed on Sept. 16, 1974, and now abandoned.

BACKGROUND OF THE INVENTION

In an article appearing in the October, 1967, volume of the "Air Conditioning, Heating and Ventilation" magazine, Milton Eaton, the inventor of the present invention, suggested that an electrode steam boiler of the type known as an Eaton automatic electric steam generator and described in Section 8 - 13, Standard Handbook for Electrical Engineers be used as the direct source of HTW for a heating system.

In the system shown and described in that article, steam was to be removed from the boiler for steam heating purposes and an additional limited amount of steam was to be removed for control purposes. HTW was to be taken from the boiler for supply to a HTW heating circuit. A proportioning valve was interconnected between the boiler and HTW heating system.

Mr. Eaton has subsequently found it is necessary to provide for unrestricted flow of HTW from the boiler to the heated spaces circuit in order for the boiler to serve as a pressurized expansion tank for the heating system. This is because action of the proportioning valve would, from time to time, restrict flow of HTW from the boiler to the HTW heating system. This would cause loss of pressure in the heating system with consequent occurrence of flash steam that would prevent normal circulation of HTW through the system.

Mr. Eaton has further discovered that an electrode steam boiler of the type known as an Eaton automatic electric steam generator will operate normally as a source of HTW with the steam output limited to that required for automatic control purposes. The boiler water is circulated as HTW through a space heating system and returned to the boiler where it is heated to steam temperature as required for the boiler steam pressure controller to maintain the boiler steam pressure at the controller set point. It is not necessary to remove the relatively large amounts of steam associated with a steam heating system, for instance. However, the boiler may be used as the source of steam for other services not associated with the HTW space heating system.

Design features of the Eaton automatic steam boiler that make it suitable for this application are (1) the boiler load can be limited to the steam output required for control purposes, (2) the water-jet action whereby water is taken from the boiler, water from an outside source mixed with it, and the mixture is pumped through water spouts with nozzles and directed towards the tips of the electrodes with sufficient velocity to flow up the sides of the electrodes to the water level controlled by the boiler steam pressure controller, and (3) the tip-shielded electrode.

For use in supplying HTW for a space heating system, however, provision must be made to prevent adverse operating conditions and to provide suitable conditions for normal operation.

SUMMARY OF THE INVENTION

It is therefore an object of the present invention to provide an improved HTW heating system in which the direct source of HTW is an automatic electrode steam boiler.

It is another object of this invention to provide such an improved HTW heating system, including means providing for unrestricted flow of HTW from the boiler to the heated spaces circuit.

It is further an object of this invention to provide such an improved HTW heating system in which only a limited amount of steam is removed from the boiler for control purposes.

It is yet another object of this invention to provide such an improved HTW space heating system in which the electrical load of the boiler is effectively controlled.

In accordance with one aspect of the present invention, there is provided an HTW heating system in which the direct source of HTW is an automatic electrode steam boiler. The boiler has at least one electrode positioned in a corresponding at least one steam generating compartment, surrounded by a control compartment. A corresponding at least one water spout is positioned for directing water toward the tip of the at least one electrode.

The heating system includes means providing for only limited steam output from said boiler, which is used for control purposes. The heating system also has means, including a boiler water pump, for mixing water taken from the boiler with water from an outside source and pumping the mixed water through the at least one spout with sufficient velocity for the water to flow up the surface of the at least one electrode to the water level in the at least one steam generating compartment.

There is a heated spaces circuit, having pumping means for circulating HTW through the heated spaces circuit. An HTW supply circuit connects the boiler with the heated spaces circuit and provides for unrestricted flow of HTW from the boiler to the heated spaces circuit so the boiler serves as a pressurized expansion tank for the heating system.

The inlet of the boiler water pump is connected to the boiler and the outlet is connected to the at least one water spout. A diversion circuit connects the heated spaces circuit with the boiler water pump inlet. There is a control means for diverting a controlled amount of HTW from the heated spaces circuit, through the diversion circuit, to the boiler water pump inlet. Such diverted HTW constitutes water from an outside source and the HTW diverted from the heated spaces circuit is replaced with HTW from the boiler through the HTW supply circuit.

BRIEF DESCRIPTION OF THE DRAWINGS

This specification concludes with claims particularly pointing out and distinctly claiming the subject matter which is regarded as the invention. The invention itself, however, as well as further objects and advantages thereof, may be better understood from the following description taken in conjunction with the accompanying drawings, in which:

DESCRIPTION OF THE PREFERRED EMBODIMENT

Figure 1:
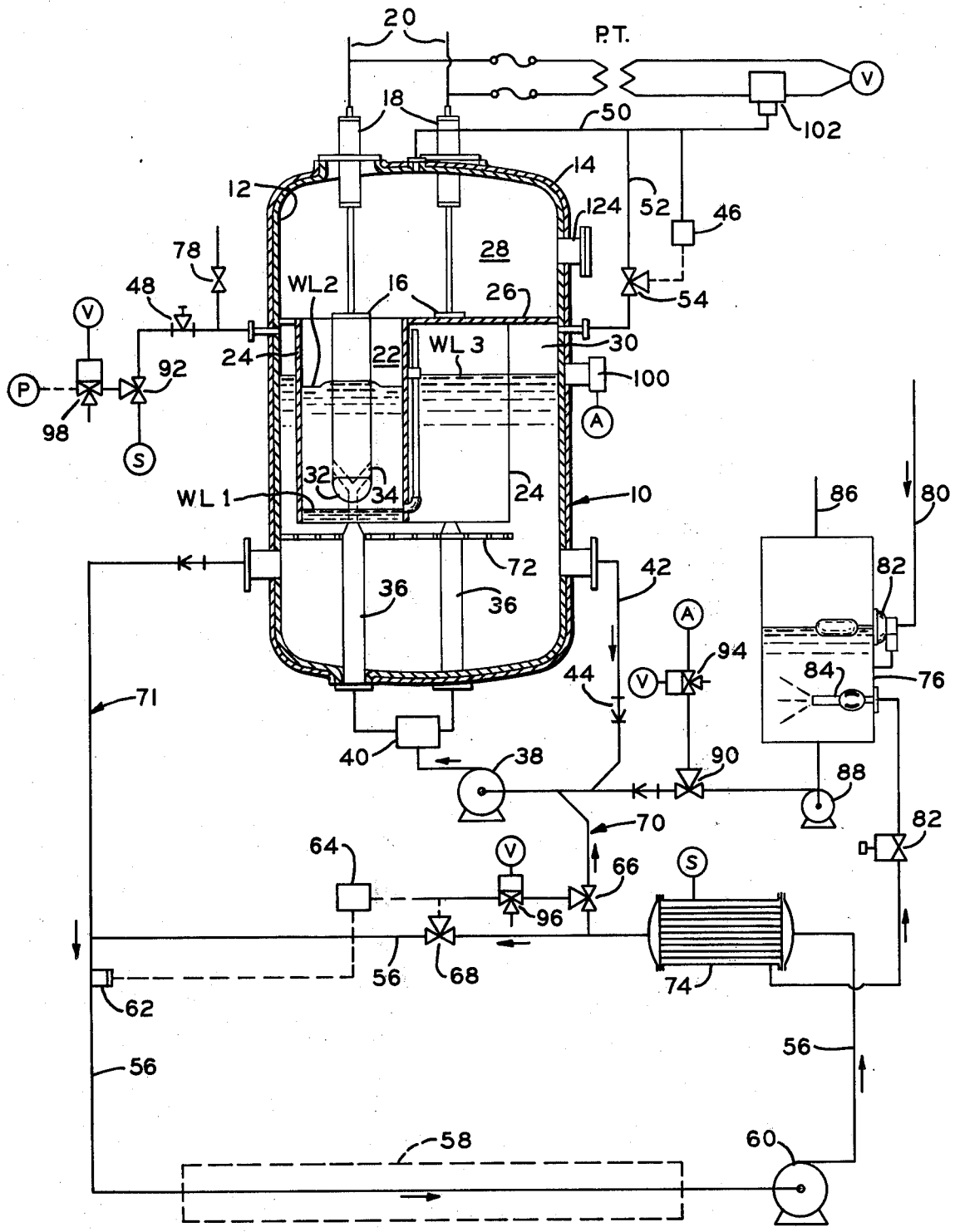
FIG. 1 is a schematic diagram of an HTW space heating system incorporating one embodiment of the present invention.

Referring now to FIG. 1, there is shown, in schematic form, a high temperature water (HTW) space heating system in which an automatic electrode steam boiler 10 is the direct source of HTW. The boiler 10 includes a pressure vessel 12 substantially enclosed by insulation 14. One or more electrodes are mounted in the vessel. Typically, there are three electrodes, two of which are shown at 16, when the boiler is to be powered from a three phase electrical distribution system. Each electrode 16 is supported from the vessel 10 by a terminal structure 18. The terminals 18 also serve to connect the electrodes 16 with the electric supply conductors 20, which are part of the electrical distribution system.

Each electrode is positioned in a corresponding steam generation compartment 22 formed by a neutral wall 24. The neutral walls 24 are supported from the vessel 12 by a diaphram 26. The space above the diaphram is a steam release compartment 28 while the space below the diaphram, surrounding the steam generating compartments 22, is a control compartment 30.

The lower end of each electrode 16 is provided with a tip shield 32 which forms tip shield passages 34. The electrode tip shields 32 are made to function as guides and to limit diffusion. A water spout or nozzle 36 is positioned below each electrode. The spouts discharge a mixture of water taken from the boiler and water from an outside source with sufficient velocity carry the water mixture through the tip shield passages 34 and up the outer surface of the corresponding electrode 16 to water level WL2.

The jetted water returns to the bottom of the boiler around the sides of the steam generating compartments 22 adjacent to the neutral compartment walls 24, thus making two passes through the steam generating compartments 22. There will be some diffusion from the water jets but if the boiler steam pressure is held at the predetermined set point of steam pressure controller 46, the temperature of the boiler water will be held close to steam temperature, at which it is discharged to the heating system as HTW.

The water mixture is provided to the spouts by a boiler water pump 38. The outlet of the pump is connected to the spouts through a distributor, generally indicated at 40. Water is supplied to the inlet of pump 38 from the boiler through a conduit 42 with one-way valve 44.

A limited amount only of steam is removed from the boiler 10 through valve 48 for control purposes. Valve 48 is adjusted to bleed-off steam from the upper portion of control compartment 30 at the rate equivalent to about 1% of the boiler full load. The steam release compartment 28 is connected to the upper portion of control compartment 30 by conduits 50 and 52. A control valve 54 is connected in conduit 52 and is responsive to steam pressure controller 46. When the boiler steam pressure rises above the set point of controller 46, valve 54 decreases the rate at which steam enters the control compartment 30 below the rate at which it is discharged through valve 48, thus causing WL2 to fall and the boiler load to be decreased. Conversely, when boiler steam pressure falls below the set point of controller 46, valve 54 opens to increase the rate at which steam enters the control compartment 30, causing WL2 to rise and the boiler load to increase.

There is a heated spaces circuit 56 for circulation of HTW through spaces to be heated, schematically indicated at 58. The HTW is circulated through the heated spaces circuit 56 by a heated spaces pump 60. A thermostat 62 is connected in the entry portion of the heated spaces circuit 56 to measure the temperature of HTW at that point. A temperature controller 64 is connected to the thermostat 62 and to control valves 66 and 68. Valve 68 is in the heated spaces circuit 56 while valve 66 is in a diversion circuit 70 which connectes heated spaces circuit 56 to the inlet of boiler water pump 38. The temperature controller 64 controls valves 66 and 68 in response to the HTW temperature measured by the thermostat 62. When the measured temperature falls below a predetermined level, the controller causes the opening through the valve 68 to be reduced and the opening through control valve 66 to be enlarged. This causes a controlled amount of HTW to be diverted from the heated spaces circuit 56, through the diversion circuit to the inlet of pump 38. Pump 38 mixes the diverted HTW, whch constitutes water from an outside source, with water taken from the boiler and directs the mixed water to the boiler where it is heated to the boiler steam temperature.

An HTW supply circuit 71 connects the boiler 10 to the input of heated spaces circuit 56 so that HTW diverted from the heated spaces circuit is simultaneously replaced with HTW from the boiler as required to maintain the temperature of the water entering the heated spaces circuit at the set point of the temperature controller. The HTW supply circuit 71 is sized to provide unrestricted HTW flow from the boiler to the heated spaces circuit so that the boiler operates as a pressurized expansion tank for the heating system.

HTW is circulated through the heating system and the boiler at a relatively high rate as compared with the rate of circulation through the boiler for water-jet action when the boiler output is entirely steam. Example: Assume a boiler rating of 20 MW, operation at 225 psig (steam temperature 397° F), a full load HTW temperature range through the heating system of 350° to 200° F, 3400 Btu/kWh and a heating system as shown schematically in FIG. 1, then the minimum rate at which pump 60 must circulate the $$\text{HTW is } \frac{20000 \times 3400}{8 \times 150 \times 60} = 950 \text{ US gpm.}$$

Assume both pumps 38 and 60 to be rated at 1000 US gpm. When the output is entirely steam, the water-jet action rate of flow is 250 US gpm for a 20 MW boiler.

Boiler modifications made to accommodate the higher rate of flow of water for water-jet action as compared with that of a boiler supplying a steam load only include (1) larger water spouts with nozzles designed to give the jetted water sufficient velocity to carry the water through the tip shield passages and up the sides of the electrodes, (2) tip shields designed to serve as guides to limit diffusion and to direct the jetted water up the sides of the electrodes, and (3) a perforated steel plate 72 located in alignment with the steam generating compartments and below the outlet end of the water spouts to minimize disturbance of the water jet action that may be caused by the high rate of flow of water into and out of the boiler.

It has been found in practice that an excessive amount of air in the boiler steam will cause unstable operation as evidenced by pulsating load current and audible disturbances similar to water hammer. Provision is made for the removal of non-condensable gases, such as air. By taking the steam discharged from the boiler for control purposes from the top of the boiler through valve 48, passing it through a heat exchanger 74 to a vented make-up tank 76, the boiler has the inherent operating characteristics of a deaerator (the connection to the heat exchanger is indicated by the letters "S"). On start-up, air in the boiler is released through valve 78.

The make-up tank 76 is used to make-up losses in the water in the system, which normally can occur as the result of the venting action or periodic blow-down. The tank receives make-up water through inlet pipe 80 and the level of water in the tank is maintained by regulator 82. The steam from heat exchanger 74 passes through a relief valve 82 and enters the tank through heater 84. The tank is open to the atmosphere through vent 86. Make-up water is pumped to boiler water pump 38 (and thus into the boiler) by a pump 88 through a control valve 90. Control valve 90, as well as control valve 66 and a control valve 92 connected between valve 48 and heat exchanger 74 are all of the diaphram normally closed air-operated type. Valves 94, 96 and 98 are located in the control air supply connections to valves 90, 66 and 92 respectively. A water level controller 100 measures the water level WL3 in control compartment 30 and is interconnected with valve 94 (as indicated by the letters "A"). When controller 100 senses that WL3 is low, the opening of control valve 90 is increased to pass make-up water from tank 76 to the boiler at an increased rate. The make-up water supplied to the boiler also constitutes water from an outside source.

The condictivity of the water in the boiler and the heating system is adjusted to that for which the boiler is designed by the addition of a suitable salt solution. The conductivity of the water in the boiler and heating system will slowly rise or fall depending on whether the conductivity of the leakage losses is more or less than that of the make-up water. The HTW conductivity is indicated by the water level on the electrodes corresponding with the boiler load current. If the water level WL2 is higher than normal salt solution is admitted to the make-up tank. If WL2 tends to be lower than normal, periodic operation of the boiler blowdown valve (not shown) is required. Since these adjustments need not be more frequent than once a day or a week, automatic operation is not required.

The boiler operates as the pressurized expansion tank for the heating system with the boiler steam pressure serving as the basic heating system pressure. There must therefore be unrestricted flow of HTW from the boiler to the heating system. Any HTW diverted from the heating system to the boiler is simultaneously replaced by HTW from the boiler as required to maintain normal heating system pressure. In the event of loss of boiler power or steam pressure, all access of water to and discharge of steam from the boiler must be stopped to limit the loss of boiler steam pressure. This is accomplished by the use of boiler isolation control voltage "$v$", which is a measure of the boiler voltage and which is interrupted if the boiler steam pressure, as measured by pressure switch 102 falls a predetermined amount. As shown in FIG. 1, isolation control voltage "$v$" is taken from potential transformer PT connected with the boiler electric power supply and in series with the normally open contacts of pressure switch 102. In the event of loss of boiler voltage or boiler steam pressure, the isolation control voltage will be interrupted (reduced to zero). Valves 94, 96 and 98 are connected to be responsive to the boiler isolation control voltage and are arranged to cut off and vent to atmosphere the diaphram air pressure, thus causing control valves 90, 66 and 92 to close, in the event of loss of isolation control voltage.

If the boiler power is interrupted for an extended period, it is essential that the boiler steam pressure should not fall faster than the temperature of the HTW in any part of the heating system; otherwise flash steam will occur. This depends on the volume of HTW in the boiler providing steam accumulator effect and the amount of boiler heat insulation. The boiler is provided with adequate HTW storage space and heat insulation at least sufficient to prevent the boiler steam pressure falling faster than the HTW temperature in any part of the heating system in the event of boiler power failure.

Figure 2:
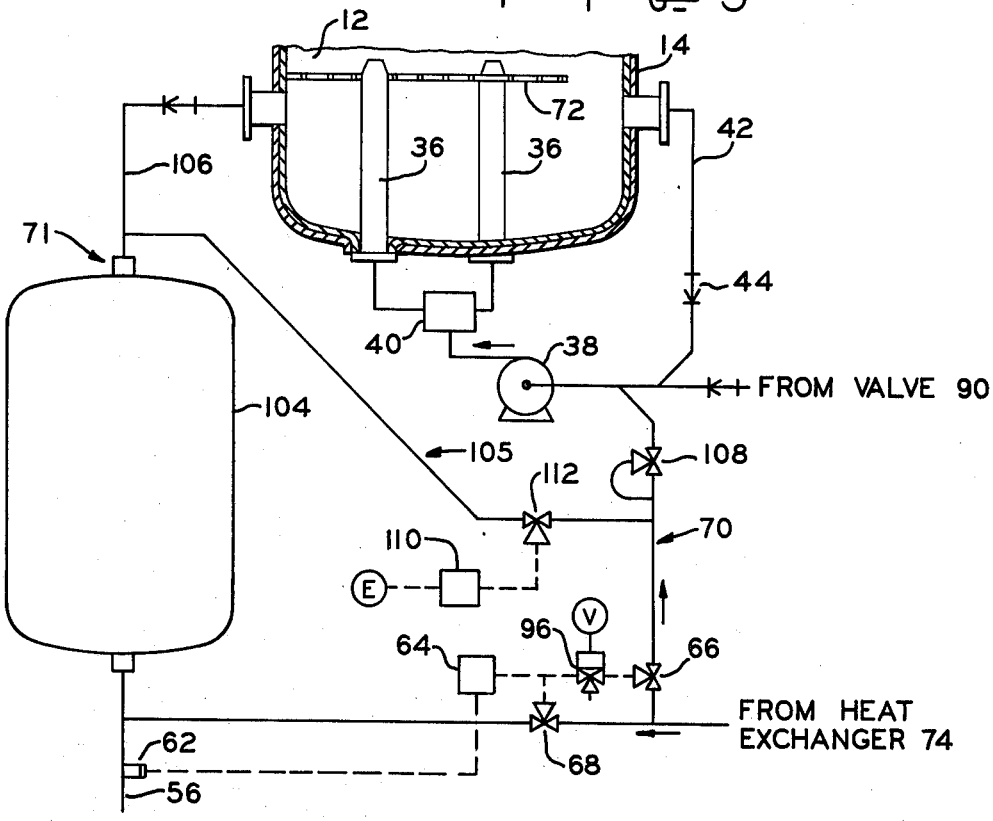
FIG. 2 is a schematic diagram of a portion of an HTW system similar to FIG. 1, but illustrating certain details of a modified system.

Referring now to FIG. 2, there is schematically shown means for limiting the maximum demand in a power distribution system of which the boiler load is a part. FIG. 2 shows a modification of FIG. 1 and equivalent components have been identified with the same reference numerals. One or more HTW storage tanks 104 are located in the HTW supply circuit 71 and a bypass circuit 105 is connected between diversion circuit 70 and pipe 106 on the boiler side of the HTW storage tank 104. Back pressure control valve 108 maintains a diversion control pressure on the boiler water pump inlet. A power controller 110 measures the power taken by the distribution system (indicated by "E") and operates control valve 112 to divert HTW from the boiler as required to reduce boiler load to limit the system load to the set point of the power controller.

Figure 3:
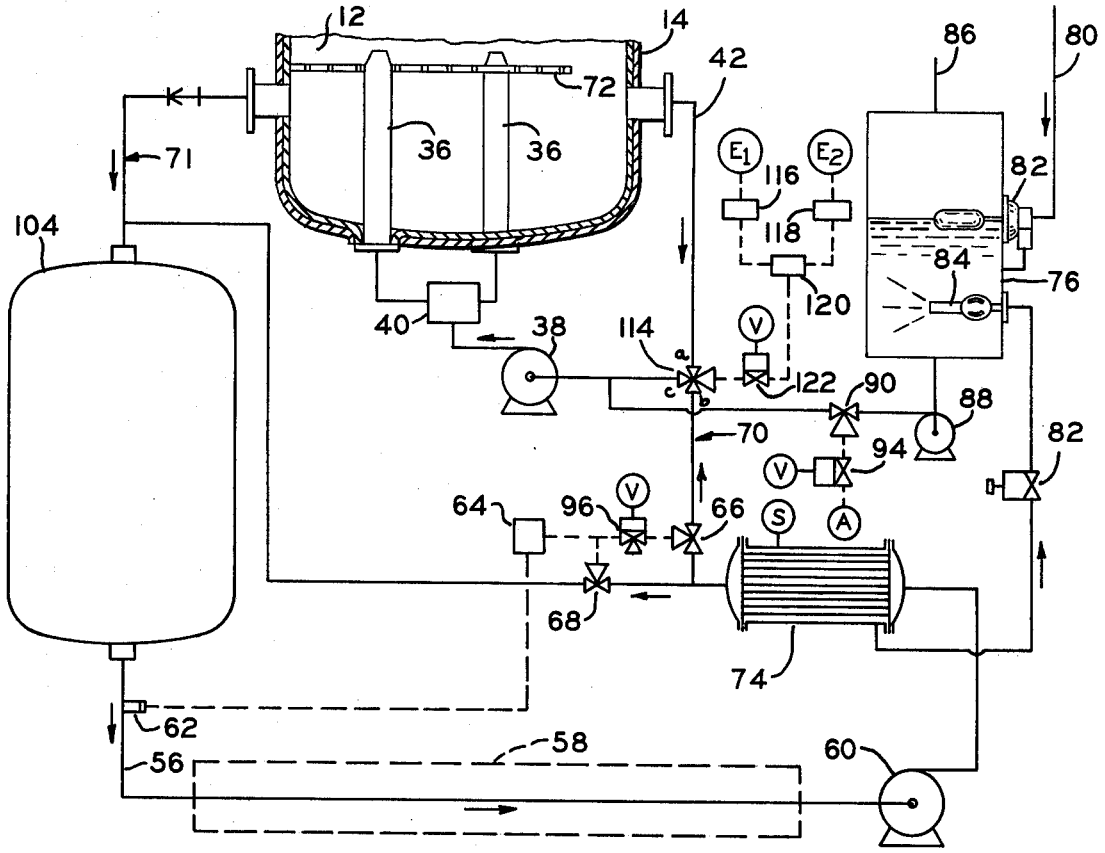
FIG. 3 is a schematic diagram similar to FIG. 2 but illustrating certain other aspects of the invention.

FIG. 3 shows schematically a preferred equipment arrangement and interconnections including means for limiting the maximum demand in a power distribution system of which the boiler load is part. It is a modification of the system of FIG. 1 and equivalent components have been identified with the same reference numerals.

One or more storage tanks 104 are located between the boiler and the heated spaces circuit 56. Pump 60 circulates HTW taken from storage tank 104 through the heated spaces circuit and back to the boiler and the storage tanks. A 3-way control valve 114 is provided with HTW communication from the boiler through conduit 42 and from heated spaces circuit 56 through the diversion in circuit 70. The water pumped through the boiler water spouts 36 by pump 38 for water-jet action is a mixture of recirculated boiler water and water taken from the heated spaces circuit. The proportion of each and the consequent boiler load is determined by the throttling position of the control valve 114, which is controlled by power controllers 116 and 118 with automatic selector station 120. Power controller 116 responds to the electric power demand (indicated by "$E_1$") at a selected point in the electrical distribution system in which the boiler is connected. Power controller 118 responds to the electric power demand (indicated by "$E_2$") of the boiler itself. The automatic selector station interconnects the power controllers with a valve 122 which is in the air supply line for control valve 114. The selector station 120 transmits to the valve 122 the controller output air pressure which is nearest to that corresponding with the upper limit of boiler or total load as determined by the set points of the controllers.

The three-way control valve 114 acts as the composite to two valves having a service similar to that of valves 66 and 68 in FIG. 1. Rising control air pressure increases the control valve 114 opening in direction bc and decreases the opening in direction ac. Conversely, falling control air pressure decreases control valve opening in direction bc and increases the opening in direction ac. The valve 122 also is connected to the boiler isolation control voltage "*v*". In the event of loss of isolation control voltage "*v*", valve 122 functions to cause valve 114 to close in direction bc and to open in direction ac, this causes the boiler load to drop to a minimum value.

Assuming the boiler to be operated at 225 psig, the boiler HTW output temperature to be 390° F and that at full heating load the temperature of the HTW pumped through the heating system falls 150° F, then the temperature of the HTW entering the heated spaces circuit at any time will be less than 390° F by an amount depending on the actual heating load, the loss of boiler load caused by the operation of the maximum demand controllers and the amount of usable heat in the HTW of the storage tanks.

In accordance with one embodiment of this invention, there is provided economic means whereby an electrode steam boiler of the type having limited steam outlet for control purposes, water-jet action and tip-shielded electrodes, is used to directly supply the HTW for an HTW space heating system.

Some advantages obtained, as compared with the combined use of an electrode steam boiler and a direct contact steam heater, are that a direct contact steam heater is not required, conductivity control is simplified, and equipment and maintenance costs are reduced.

The preferred embodiments of the invention have been described in detail. Modifications may, however, be made without departing from the spirit or scope thereof. For example, the boiler isolation valves may be separate solenoid-operated valves responsive to the boiler isolation control voltage provided they are designed for operation at the temperature to which they would be subjected. Further, although a 3-electrode boiler design is preferred for 3-phase high voltage operation, other electrode arrangements, such as a 6-electrode design, may be used. It should also be understood that although the electrode tip shields are a desirable improvement, the water-jet action can be made to function without them. Provision can also be made for other use of part of the steam generated in which case the boiler steam outlet 124, shown closed with a blank flange in FIG. 1, would be used for this purpose. Means similar to that shown in FIG. 2 can be used to transfer the heating load to a fuel-fired boiler to limit peak loads on the distribution system of which the boiler load is part. It is applicant's intention in the following claims to cover all equivalent variations as fall within the true spirit and scope of the invention.

What applicant claims as new and desires to secure by Letters Patent of the United States is:

1. In an HTW space heating system in which the direct source of HTW is an automatic electrode steam boiler including a pressure vessel having at least one steam generating compartment surrounded by a control compartment, at least one electrode in said vessel and adapted to be connected in an electrical distribution system, said at least one electrode being positioned in a corresponding at least one steam generating compartment surrounded by a control compartment, a corresponding at least one water spout in said vessel for directing water toward the tip of said at least one electrode and said boiler including means for maintaining a predetermined minimum HTW level in said vessel, the improvement in said HTW heating system including:

a. means providing for limited steam output for the at least one steam generating compartment of said boiler, such limited steam output being utilized for control purposes by control means associated with said boiler;

b. means, including a boiler water pump, for mixing HTW water taken from the boiler with water from an outside source and pumping the mixed water through said at least one water spout with sufficient velocity for the water to flow up the surface of said at least one electrode to the water level in said at least one steam generating compartment;

c. a heated spaces circuit having pumping means for continuously circulating HTW through said heated spaces circuit;

d. an HTW supply circuit connecting said boiler with said heated spaces circuit and providing for unrestricted flow of HTW from said boiler to said heated spaces circuit so that said boiler serves as a pressurized expansion tank for said heating system;

e. said boiler water pump having an inlet connected to the HTW in said boiler and an outlet connected to said at least one water spout, a diversion circuit connecting said heated spaces circuit with said boiler water pump inlet; and f. control means responsive to a condition associated with the heated spaces for selectively diverting a controlled amount of HTW from said heated spaces circuit through said diversion circuit to said boiler water pump inlet; such diverted HTW constituting water from an outside source, and the HTW diverted from said heated spaces circuit being replaced with HTW from said boiler through said HTW supply circuit.

2. An HTW space heating system as set forth in claim 1, wherein said control means includes a thermostat responsive to the temperature of HTW in said heated spaces circuit, a control valve connected in each of said heated spaces circuit and said diversion circuit respectively, and a temperature controller connecting said thermostat with said control valves so that said control valves are responsive to said thermostat for selectively diverting HTW from said heated spaces circuit to said diversion circuit in response to a predetermined temperature of the circulating HTW in the heated spaces circuit.

3. An HTW space heating system as set forth in claim 2, further including:

a. a tank, vented to atmosphere, to contain a supply of make-up water and means, including a regulated valve, for feeding make-up water from said tank to said boiler water pump inlet, such make-up water further constituting water from an outside source;

b. a heat exchanger for condensing steam;

c. means connecting said heat exchanger to said vented tank so that condensed steam becomes part of the make-up water and non-condensable gases from the steam are vented to atmosphere; and d. wherein said means providing for limited steam output from said boiler is connected to said heat exchanger for feeding such steam output to said heat exchanger and includes a regulated valve or controlling the flow of steam to said heat exchanger.

4. An HTW space heating system as set forth in claim 3, further including:

a. control means adapted to be connected in the electrical distribution system in which the at least one electrode is connected and effective to provide a boiler isolation control voltage;

b. switch means connected to said control means and responsive to steam pressure in said boiler being below a predetermined level to interrupt the boiler isolation voltage; and c. means connected to each of said control valve in said diversion circuit and said regulated valves and responsive to interruption of the boiler isolation control voltage to cause each of said control valve in said diversion circuit and said regulated valves to close.

5. An HTW space heating system as set forth in claim 1 further including at least one HTW storage tank connected in said HTW supply circuit between said boiler and said heated spaces circuit and a bypass circuit connected between said diversion circuit and said HTW supply circuit at a point in said supply circuit between said boiler and said at least one HTW storage tank and a point in said diversion circuit between said control means and said boiler water pump inlet; an electrical power controller adapted to make power measurements at a predetermined point of the electrical distribution system in which said at lease one electrode is connected; a bypass control valve connected in said bypass circuit and responsive to said electrical power controller for diverting HTW from said diversion circuit to said at least one HTW storage tank and bypass said boiler to control the electrical load resulting from boiler operation.

6. An HTW space heating system as set forth in claim 5, wherein a back pressure control valve is included in said diversion circuit between said boiler water pump inlet and the connection between said diversion circuit and said bypass circuit for maintaining a diversion control back pressure on said boiler water pump inlet.

7. An HTW space heating system as set forth in claim 1 wherein a perforated steel plate is positioned in said boiler below the outlet of said at least one water spout and in alignment with said corresponding at least one steam generating compartment to minimize disturbance of the water jet action by the flow of water into and out of said boiler.

8. An HTW space heating system as set forth in claim 1 wherein said boiler includes means providing for passage of steam from said at least one steam generating compartment to said control compartment and wherein said means providing for limited steam output from said boiler includes means for venting non-condensable gases to atmosphere.

9. An HTW space heating system as set forth in claim 1, wherein said control means further includes control valve means having an outlet and two inlets, said control valve means outlet being connected with said boiler water pump inlet, one of said control valve means inlets being connected to HTW in said boiler and the other of said control valve means inlets being connected to said diversion circuit; valve control means effective to adjust the portions of water entering said control valve means through each of said valve means inlets; and at least one electrical power controller adapted to make power measurements at a predetermined point of the electrical distribution system in which said at least one electrode is connected; said electrical power controller being operatively connected to said control means so that the proportions of water entering said control valve means through each of said valve means inlets are responsive to the power measurement of said electrical power controller.

10. An HTW heating system as set forth in claim 1, wherein said boiler vessel has sufficient heat insulation to limit, in the event of an extended power interruption, the falling of boiler steam pressure in relation to the falling of the temperature of the HTW in any part of the heating system for avoiding the occurrance of flash steam.

11. An HTW heating system as set forth in claim 1, wherein said at least one electrode has a tip shield shaped as a guide to direct jetted water, directed from the associated water spout, up the outer surface of said at least one electrode and to limit diffusion of the jetted water.

* * * * *